United States Patent [19]

Murata et al.

[11] 4,028,280

[45] June 7, 1977

[54] NON-PHOSPHATE OR REDUCED PHOSPHATE DETERGENT COMPOSITIONS CONTAINING MIXTURES OF ALKYL ETHER SULFATES

[75] Inventors: Moriyasu Murata, Chiba; Fumio Sai, Funabashi; Takashi Fujino, Yokohama, all of Japan

[73] Assignee: Kao Soap Co., Ltd., Tokyo, Japan

[22] Filed: Aug. 18, 1976

[21] Appl. No.: 715,379

[30] Foreign Application Priority Data

Sept. 4, 1975 Japan ..... 50-107367

[52] U.S. Cl. ..... 252/526; 252/532; 252/545; 252/551

[51] Int. Cl.[2] ..... C11D 3/065; C11D 3/08; C11D 1/14

[58] Field of Search ..... 252/532, 552, 526, 545

[56] References Cited

UNITED STATES PATENTS

| | | | |
|---|---|---|---|
| 3,468,805 | 9/1969 | Grifo et al. | 252/532 X |
| 3,513,099 | 5/1970 | Hans et al. | 252/551 X |
| 3,775,349 | 11/1973 | Tuvell et al. | 252/550 X |
| 3,957,671 | 5/1976 | Sagel et al. | 252/142 |
| 3,959,186 | 5/1976 | Harris | 252/551 |
| 3,960,780 | 6/1976 | Murata et al. | 252/532 |

OTHER PUBLICATIONS

Bistline et al., "Synthetic Detergents from Animal Fats", X. Sulfated, Ethenoxylated Tallow Alcohols, Journal of the American Oil Chem. Society.

*Primary Examiner*—P.E. Willis, Jr.
*Attorney, Agent, or Firm*—Woodhams, Blanchard and Flynn

[57] ABSTRACT

A detergent composition comprising as all or a part of the active detergent component (A) a mixture of up to 70% by weight of unbranched-alkyl ether sulfate, or mixtures thereof, having the formula (I):

$$R_1—O—(CH_2CH_2O)_nSO_3M \quad (I)$$

wherein $R_1$ is unbranched alkyl ($CH_3(CH_2)_p$—) having a total number of from 6 to 15 carbon atoms and having a carbon atom number distribution such that the average carbon atom number is within the range of from 8 to 13, n is from 0.5 to 1.5 as an average number in the mixture, and M is alkali metal, alkaline earth metal, ammonium or alkanol amine, and at least 30% by weight of a branched alkyl ether sulfate, or mixtures thereof, having the formula (II):

$$R_2—\underset{\underset{R_3}{|}}{CH}—CH_2—O—(CH_2CH_2O)_nSO_3M \quad (II)$$

wherein $R_2$ is an unbranched alkyl having 1 to 12 carbon atoms, $R_3$ is an unbranched alkyl having 1 to 4 carbon atoms, the group $$R_2—\underset{\underset{R_3}{|}}{CH}—CH_2—$$

having a carbon number distribution such that the average carbon atom number thereof is within the range of from 8 to 13, and n and M are as defined above for formula (I), and (B) an unbranched alkyl ether sulfate, or mixtures thereof, having the formula (III):

$$R_4—O—(CH_2CH_2O)_mSO_3M \quad (III)$$

wherein $R_4$ is unbranched saturated alkyl in which the alkyl group having 18 carbon atoms occupies at least 80 percent by weight of the whole component (B), m is 1 to 50 on the average and M is as defined above for formulae (I) and (II), the ratio of (A) to (B) being in the range between 95 : 5 and 5 : 95.

7 Claims, No Drawings

NON-PHOSPHATE OR REDUCED PHOSPHATE DETERGENT COMPOSITIONS CONTAINING MIXTURES OF ALKYL ETHER SULFATES

BACKGROUND OF THE INVENTION

1. Field of the Invention

This invention relates to a detergent composition which possesses excellent resistance to hard water, in which the amount of sodium tripolyphosphate employed as a builder can be greatly reduced or sodium tripolyphosphate can be entirely omitted, and which possesses an excellent rinsing property after washing.

2. Description of the Prior Art

Although the demand for sodium tripolyphosphate as a builder component in detergents has been increasing, various limitations have been imposed on the use of this builder because of the wide-spread shortage of phosphate rock, its high price and the like. Further, it is known that phosphate components contained in discharged washing solutions cause eutrophication and pollution in rivers and the lakes. Accordingly, in the detergent art, there have been serious problems of how to reduce the amount of sodium tripolyphosphate and how to utilize it moe efficiently in detergents.

Various attempts have heretofore been made to solve these problems, and these known attempts are generally divided in two types; one type is directed to a method in which another builder is used as a substitute for sodium tripolyphosphate and the other type is directed to a method in which a surface active agent possessing excellent resistance to hard water is used as the effective detergent component. In the former method, however, there has not been discovered any practical builder that can be used instead of sodium tripolyphosphate and that will provide satisfactorily good results with respect to washing ability, cost and other factors, safety and the like. In the latter method, the use of hard water-resistant polyoxyethylene alkyl ether sulfates (hereinafter referred to simply as "ether sulfates" or "ES"), which are salts of sulfuric acid esters of adducts of 3 to 5 moles of ethylene oxide to higher alcohols having 12 to 18 carbon atoms in the alkyl group, has been proposed and practiced. These ether sulfates, which have good effectively used for detergents, have a good resistance to hard water, but they have a foaming characteristic such that foaming increases with an increase of water hardness at low concentrations. This characteristic makes it difficult to remove foam during the rinsing step after washing. In fact, in the case of ether sulfate-containing detergents for clothing, tableware, hair, furniture or the like, foams do not disappear smoothly and sufficiently during the rinsing or finishing step. This defect in rinseability decreases the commercial value of detergent products. Accordingly, if this defect can be ameliorated, it will be possible to provide a phosphate-free or low phosphate detergent having a high commercial value and which can be easily used by consumers with saving of rinsing water.

In order to overcome the foregoing defects, we previously proposed, in the U.S. Patent Application Ser. No. 663,912 filed on Mar. 4, 1976, a detergent composition including an ether sulfate of a special structure having a greatly reduced number of carbon atoms in the alkyl group, a high branching ratio and a greatly reduced number of moles of added ethylene oxide, which special ether sulfate had heretofore not been used in the detergent art, which detergent composition had a high resistance to hard water and a greatly improved rinsing property.

Since soils adhered on fabrics contain various oily components differing in the polarity, when surface active agents suitable in its affinity for respective oily components are used, these oily soils can be washed away more readily. Accordingly, in the above detergent free of sodium tripolyphosphate (phosphate-free) or having a reduced sodium tripolyphosphate content (low-phosphate) which has a high washing power, it is expected that if ether sulfates of other types are used in combination, the washing power will be further improved. In general, by adding of these other types of ether sulfate, excellent washing power due to high resistance to hard water may be obtained, but the rinsing property, another important property, is degraded.

SUMMARY OF THE INVENTION

We therefore furthered our research works with a view to solving these problems and found that a phosphate-free or low-phosphate detergent composition comprising ether sulfates having a specific structure at a specific ratio has a good rinsing property and a synergistically improved washing power. We have now completed the present invention based on this finding.

More specifically, in accordance with this invention, there is provided a detergent composition comprising as all or a part of the active surfactant component, (A) a mixture of up to 70% by weight of an unbranched-alkyl ether sulfate, or mixtures thereof, having the formula (I):

$$R_1-O-(CH_2CH_2O)_nSO_3M \qquad (I)$$

wherein $R_1$ is an unbranched alkyl ($CH_3(CH_2)_p-$) having a total number of from 6 to 15 carbon atoms and having a carbon atom number distribution such that the average carbon atom number is within the range of from 8 to 13, n is from 0.5 to 1.5 as an average number in the mixture, and M is alkali metal, alkaline earth metal, ammonium or alkanol amine, and at least 30% by weight of a branched-alkyl ether sulfate having the formula (II):

$$R_2-\underset{\underset{R_3}{|}}{CH}-CH_2-O-(CH_2CH_2O)_nSO_3M \qquad (II)$$

wherein $R_2$ is an unbranched alkyl having 1 to 12 carbon atoms, $R_3$ is an unbranched alkyl having 1 to 4 carbon atoms, with the proviso that the group $$R_2-\underset{\underset{R_3}{|}}{CH}-CH_2-$$

has a carbon atom number distribution such that the average carbon atom number is within the range of from 8 to 13, and n and M are as defined above for formula (I), and (B) an unbranched alkyl ether sulfate, or mixtures thereof, having the formula (III):

$$R_4-O-(CH_2CH_2O)_mSO_3M \qquad (III)$$

wherein $R_4$ is unbranched saturated alkyl having from 14 to 20 carbon atoms in which the alkyl group having 18 carbon atoms occupies at least 80 percent by weight of the whole component (B), m is 1 to 50 on the average and M is as defined above for formulae (I) and (II), the ratio of (A) to (B) being in the range between 95:5 and 5:95.

The detergent composition of the present invention has an excellent resistance to hard water, as good as that of conventional ether sulfate-containing detergents, and it does not cause precipitation at all in water having a very high hardness. Accordingly, the amount of sodium tripolyphosphate incorporated in the detergent composition of the present invention can be greatly reduced as compared with conventional detergents comprising as an active surfactant component a linear alkyl benzenesulfonate (hereinafter referred to as "LAS") or an olefin sulfonate (hereinafter referred to as "OS"). Indeed, sodium tripolyphosphate can be completely omitted. Further, even a phosphate-free or a low phosphate detergent composition of the present invention shows a very high washing power. Still further, the desirable characteristics of known ether sulfate detergents are completely retained in the detergent composition of the present invention, but the fatal defect of those conventional ether sulfate detergents, namely, their poor rinsing property, is substantially overcome in the detergent of the present invention. The detergent composition of the invention provides good foam breaking during the rinsing step.

These characteristic features of the present invention can be attained by using ether sulfates having a specific structure as mentioned hereinbefore.

The starting alcohol of the component (A) has a short alkyl group having 6 to 15 carbon atoms, in which the average carbon number of the alcohol mixture is within the range of from 8 to 13, and at least 30% of the total alcohols should have a branched chain on the carbon atom at the 2-position (in the instant specification, the term "branching ratio" means the proportion of such branched alcohols in the total alcohols). Such a starting alcohol mixture is known and prepared, for example, according to a process disclosed in the following literatures: G. B. Borsari, F. Buosi and E. P. Fuochi La Rivista Italiana Delle Sostanze Grasse, Vol.Ll (Giugno 1974), page 193–207 and 253–265. The ether sulfate mixture (A) can be prepared by adding ethylene oxide to such an alcohol mixture according to a conventional method and then sulfating and neutralizing the adduct. In the present invention, it is critical that the number of moles of ethylene oxide added should be small, namely, within a range of from 0.5 to 1.5 on the average. In the detergent of the present invention, a delicate balance must be established among the carbon atom number distribution, the branching ratio in the alkyl group of the ether sulfate and the number of moles of ethylene oxide added to the ether sulfate. If the carbon number of the alkyl group is too large or the branching ratio is lower than 30%, or if the number of moles of ethylene oxide added exceeds 1.5, sufficient foam breaking cannot be attained in the resulting detergent during the rinsing step. When the number of moles of ethylene oxide added is within the range of from 0.5 to 1.5 as specified in the present invention, a smaller number of carbon atoms in the alkyl group or a higher branching ratio gives a better rinsing and higher resistance to hard water.

The amount of ether sulfate of formula (I) is from zero to 70% by weight, preferably from 30 to 65 percent by weight, based on the sum of ether sulfate of formula (I) plus ether sulfate of formula (II). The balance of the total ether sulfate surfactant component is ether sulfate of formula (II).

As the ether sulfate (B) that is used in combination with the component (A) to improve the washing power synergistically without degradation of the rinsing property, there should be used an ether sulfate such that the content of an starting alcohol containing an alkyl group having 18 carbon atoms is at least 80% by weight of the total starting alcohol. If an ether sulfate obtained from an alcohol which does not satisfy this requirement is employed, the rinsing property is reduced.

In the detergent composition of the present invention, the total amount of the sum of the ether sulfates of the above general formulae (I), (II) and (III) is from 0.5 to 60% by weight, preferably from 2 to 20%. More specifically, from 0.5 to 15% by weight of ether sulfates of formulae (I), (II) and (III) can be used to replace a corresponding amount of anionic surfactant in conventional anionic powdery detergent compositions so that the content of sodium tripolyphosphate thereof can be decreased. When the detergent does not contain sodium tripolyphosphate at all, the content of the ether sulfates (I), (II) and (III) is within the range of 2.5 to 25% by weight. In the case of a liquid heavy duty detergent, the content of the ether sulfates (I) and (II) is within the range of 2.5 to 60% by weight.

In each case, it is critical that the ratio of [(1) + (II)]/(III) [namely the ratio of the component (A) to (B)] should be in the range of from 95/5 to 5/95.

The detergent composition of the present invention comprises ether sulfates of formulae (I), (II) and (III) as critical detergent component. It may further contain various conventional water-soluble anionic surfactants, except that it should not contain other ether sulfates, i.e., ether sulfates having formulas different from formulae (I), (II) and (III), such as alkyl ether sulfates and alkylphenol ether sulfates having 11 to 17 carbon atoms in the alkyl group.

The detergent composition can contain water-soluble amphoteric surfactants and water-soluble nonionic surfactants as additional detergent components. As the water-soluble anionic surfactants that can be used in combination with the ether sulfates of formulae (I), (II) and (III), there can be mentioned the anionic surfactants conventionally used for clothes washing, dishwashing and hair shampooing, for example, alkyl benzene sulfonates, alkyl sulfates, α-olefin sulfonates, alkane sulfonates, alkyl ether carboxylates and fatty acid salts having 11 to 18 carbon atoms in the alkyl group. As the amphoteric surfactants, there can be used the conventional amphoteric surfactants, for example, alkyl betaines, alkyl alanines and alkyl sulfobetaines having 10 to 20 carbon atoms in the alkyl group. Still further, there can be used, conventional nonionic surfactants such as polyoxyethylene alkyl ethers, polyoxyethylene alkylphenol ethers, polyoxyethylene fatty acid esters and polyoxyethylene sorbitan fatty acid esters having an HLB value of from 8 to 18. When surface active agents of different kinds such as those mentioned above are used in combination with the ether sulfates (I), (II) and (III), in the detergent composition of the present invention, it is critical that the total content of the ether sulfates of formulae (I) and (II) should be at least 2.5% by weight, preferably more than 10% by weight, of the total active surfactant components.

The detergent composition of the present invention can further contain from zero to 40% by weight of conventional phosphate builder salts, such as sodium tripolyphosphate, sodium pyrophosphate or sodium metaphosphate, from zero to 20% by weight of conventional heavy metal-sequestering agents such as nitrilotriacetates, ethylene diamine tetraacetates, citrates, polyacrylates or water-soluble salts of a maleic anhydride-vinyl acetate copolymer, and from 5 to 40% by weight of conventional alkaline and neutral builder salts such as silicates, carbonates, sulfates and borates. When the detergent of the present invention is a liquid detergent, it may further comprise from one to 20% by weight of conventional solubilizing agents such as ethanol, methanol, urea, a p-toluenesulfonate, a xylenesulfonate or a naphthalenesulfonate. Furthermore, an enzyme, a bleaching agent of the enzyme type, a fluorescent dye, a bluing agent, a perfume or other conventional detergent additives can be incorporated in the detergent of the present invention according to need in the range up to 3% by weight.

The present invention will now be further described by reference to the following illustrative Examples, in which all of the percent values are by weight.

EXAMPLE 1

Powder detergents for cloths having the following composition were prepared by using various surface active agents, and the washing power and the rinsing property after washing were tested according to the methods described below.

| | | |
|---|---|---|
| (1) | Composition of Detergent: | |
| | Surface active agent (shown in Table 1) | 20% |
| | Soap | 1.0% |
| | Sodium tripolyphosphate | 0 or 20% |
| | Sodium silicate | 10% |
| | Sodium carbonate | 5% |
| | Polyethylene glycol (average molecular weight = 6000) | 0.5% |
| | Carboxymethylcellulose | 0.5% |
| | Water | 10% |
| | Glauber salt | balance |
| | Total | 100.0% |
| (2) | Washing Power Test: | |

In 1 *l* of an aqueous solution of the detergent were dipped 12 artifically soiled cloths having a size of 10 cm × 10 cm, and unsoiled cloths of the same size were further put into the solution so that the bath ratio was 1/60. The washing was conducted under the following conditions by using Terg-O-Meter rotating at 100 rpm.

The washing conditions and the composition of the oil contaminant are as follows:

[Washing Conditions]

Detergent concentration: 0.1%
Hardness of water: 8° DH
Water temperature: 20° C.
Washing time: 10 minutes
Rinsing: 5 minutes by service water.

[Oil Composition of Oily Soil]

Cotton seed oil: 60%
Cholesterol: 10%
Oleic acid: 10%
Palmitic acid: 10%
Liquid and solid paraffins: 10%.

The reflectances of the unsoiled cloth, the soiled cloth before washing and the soiled cloth after washing were respectively measured by using an automatic recording color difference meter (manufactured by Shimazu Seisakusho), and the washing power (%) was evaluated calculated according to the following formula:

$$\text{Washing power (\%)} = \frac{\text{(reflectance after washing)} - \text{(reflectance before washing)}}{\text{(reflectance of non-contaminated cloth)} - \text{(reflectance before washing)}} \times 100$$

Each value shown in Table 1 is an average value obtained when the measurement was conducted on 12 sample sheets.

3 Rinsing Property Test

A palsator type electric washing machine (manufactured by Toshiba) was charged with 30 *l* of service water maintained at 20° C and 40 g of the detergent was added and dissolved in water by agitation. A contaminated cloth prepared by coating 3 g of the above-mentioned model oil contaminate uniformly on 1 Kg of a cotton underwear and was immersed in the above washing solution. The washing was conducted for 10 minutes under violent agitation by normal direction rotation and reverse direction rotation. After completion of the washing operation, the washed cloth was subjected to the action of a dehydrator. The washing solution was discharged from the washing machine and 30 *l* of clear service water maintained at 20° C was poured into the washing machine as first rinsing water. The dehydrated cloth was dipped in this rinsing water and rinsed for 3 minutes under violent agitation by normal direction rotation and reverse direction rotation. Then, the bubbling state in the washing tank was evaluated according to the following standard and the bubbling degree after first rinsing was determined. The above rinsing procedures were repeated and the bubbling degree after second rinsing was similarly determined.

The bubbling state was evaluated according to the following standard:

| Index | Bubbling State |
|---|---|
| 5 | bubbles rise like mountains and reach a meter panel of the washing machine. |
| 4 | bubbles rise like mountains but they do not reach the meter panel. |
| 3 | bubbles cover the entire liquid surface in a thickness of 3 to 5 cm. |
| 2 | bubbles cover the entire liquid in a thickness of 1 to 2 cm. |
| 1 | bubbles cover about one-half of the liquid surface in the tank but the other half of the liquid surface is not covered with bubbles. |
| 0 | no bubble was observed. |

In the actual washing operation, when the rinsing index is 2, the rinsing is quite insufficient, and even when the rinsing index is 1, the rinsing is still insufficient and the rinsing is generally further repeated.

Results of the washing power and rinsing property tests are shown in Table 1. In Table 1, the sample No. 13 is a detergent according to the present invention.

Table 1

| Detergent Sample No. | Surface Active Agent | Amount[1] (%) of STPP | Washing Power (%) | Bubbling Index first rinsing | Bubbling Index second rinsing |
|---|---|---|---|---|---|
| 1 | sodium linear dodecylbenzene-sulfonate | 20 | 25.0 | 1 | 0 |
| 2 | " | 0 | 14.9 | 1 | 0 |
| 3 | sodium α-olefin-sulfonate ($\bar{R}$ = 12) | 0 | 21.0 | 1 | 0 |
| 4 | sodium vinylidene type olefin-sulfonate ($\bar{R}$=18) | 0 | 14.0 | 1 | 0 |
| 5 | sodium alkane-sulfonate ($\bar{R}$ = 15) | 0 | 13.5 | 2 | 1 – 0 |
| 6 | sodium alkyl sulfate ($\bar{R}$ = 12.4, branching ratio = 36%) | 0 | 20.0 | 0 | 0 |
| 7 | sodium alkyl ether sulfate ($\bar{R}$ = 12.4, branching ratio = 36%, $\bar{n}$ = 0.3) | 0 | 23.2 | 1 | 0 |
| 8 | sodium alkyl ether sulfate ($\bar{R}$ = 14.5, branching ratio = 36%, $\bar{n}$ = 3.0) | 0 | 35.5 | 2 | 2 |
| 9 | sodium alkyl ether sulfate ($\bar{R}$ = 12.4, branching ratio = 36%, $\bar{n}$ = 1.0) | 0 | 35.3 | 1 | 0 |
| 10 | sodium alkyl ether sulfate ($\bar{R}$ = 18, branching ratio = 0%, $\bar{m}$ = 5) | 0 | 38.2 | 2 | 0 |
| 11 | No. 7/No. 9 = 1/1 | 0 | 30.0 | 1 | 0 |
| 12 | No. 8/No. 9 = 1/1 | 0 | 35.5 | 2 | 1 |
| 13 | No. 10/No. 9 = 1/1 | 0 | 40.1 | 1 | 0 |

Notes
[1]STPP: sodium tripolyphosphate
[2]$\bar{R}$: average carbon atom number of alkyl group
$\bar{n}$: average number of moles of added ethylene oxide
[3]Sample No. 13: sample of the present invention As will be apparent from the foregoing results, in case of LAS, a most popular surface active agent, a good rinsing property and a high washing power are obtained even on washing with water of a hardness of 8° DH, if 20% of sodium tripolyphosphate is incorporated; whereas the washing power is drastically lowered if sodium tripolyphosphate is not incorporated (samples Nos. 1 and 2). A similar tendency is observed in case of detergents comprising other anionic surface active agent (samples Nos. 3 to 5). Conventional ether sulfate-containing detergents (samples Nos. 7 to 10) are excellent over other detergents (samples Nos. 2 to 6) with respect to the hard water resistance. Among these detergents, only the detergent previously proposed by us (sample No. 9) is excellent in not only the hard water resistance but also the rinsing property. Other detergents are insufficient in the rinsing property or the washing power. Even if this ether sulfate (sample No. 9) providing a good rinsing property is used in combination with other ether sulfate (sample No. 7 or 8), the washing power is not particularly improved and the rinsing property is degraded (samples Nos. 11 and 12). In contrast, the detergent of the present invention (sample No. 13) has a synergistically improved washing power while retaining a good rinsing property.

EXAMPLE 2

In a powdery detergent for cloths having the following composition, the combination of alkyl ether sulfates (ES) was changed, and the washing power and the rinsing property after washing were examined according to the test methods described in Example 1. Results are shown in Table 2. Composition of Detergent:

| | |
|---|---|
| Sodium linear dodecyl benzene-sulfonate | 10% |
| ES [mixture of component (A) and (B); component (A) = sample No. 9 in Example 1] | 10% |
| Soap | 1% |
| Sodium tripolyphosphate | 10% |
| Polyethylene glycol (average molecular weight = 6000) | 0.5% |
| Carboxymethylcellulose | 0.5% |
| Water | 10% |
| Glauber salt | balance |
| Total | 100% |

Table 2

| Detergent Sample No. | (A)/(B) Mixing Ratio (A) | (A)/(B) Mixing Ratio (B) | ES Composition: ES of Component (B) Average Alkyl Group Carbon Number (R) | ES Composition: ES of Component (B) Branching Ratio (%) | ES Composition: Added EO Mole Number (n) | Washing Ratio (%) | Bubbling Index first rinsing | Bubbling Index second rinsing |
|---|---|---|---|---|---|---|---|---|
| 14 | (same sodium dodecyl benzene-sulfonate as sample No. 1 of Example 1) | | | | | 20 | 1 | 0 |
| 15 | (10 | 0 | 12.4 | 36 | 1) | 39 | 1 | 0 |
| | (same as sample No. 9 of Example 1) | | | | | | | |
| 16 | 0 | 10 | 8 | 0 | 5 | 20 | 2 | 2 |
| 17 | 5 | 5 | 8 | 0 | 5 | 26 | 2 | 1 |
| 18 | 0 | 10 | 12.4 | 0 | 3 | 38 | 2 | 2 |
| 19 | 5 | 5 | 12.4 | 0 | 3 | 39 | 2 | 1 |
| 20 | 0 | 10 | 12.4 | 36 | 3 | 41 | 2 | 2 |
| 21 | 5 | 5 | 12.4 | 36 | 3 | 41 | 2 | 1 |
| 22 | 0 | 10 | 16 | 0 | 1 | 37 | 2 | 2 |
| 23 | 5 | 5 | 16 | 0 | 1 | 38 | 2 | 1 |
| 24 | 0 | 10 | 16 | 72 | 1 | 40 | 2 | 2 |
| 25 | 5 | 5 | 16 | 72 | 1 | 42 | 2 | 1 |
| 26 | 5 | 5 | 16 | 72 | 5 | 44 | 2 | 1 |
| 27 | 0 | 10 | 18 | 56 | 5 | 42 | 2 | 2 |
| 28 | 5 | 5 | 18 | 56 | 5 | 44 | 2 | 2 |
| 29 | 0 | 10 | 18 | 0 | 5 | 43 | 2 | 0 |
| 30 | 5 | 5 | 18 | 0 | 5 | 48 | 1 | 0 |
| 31 | 0 | 10 | 18 | 0 | 20 | 44 | 2 | 0 |
| 32 | 5 | 5 | 18 | 0 | 20 | 49 | 1 | 0 |

As will be apparent from the foregoing results, ES as the component (B) capable of improving effectively the washing power (washing ratio) without degrading the rinsing property when combined with the component (A) is a linear alkyl ether sulfate having an average carbon number of 18 (samples Nos. 28 and 31). The detergents of the present invention (samples Nos. 30 and 32) satisfy the above two requirements (good rinsing property and high washing power) completely.

The embodiments of the invention in which an exclusive property or privilege is claimed are defined as follows:

1. A detergent composition consisting essentially of from 0.5 to 60 percent by weight of ether sulfate surfactant consisting of A. a mixture of up to 70 percent by weight of unbranched-alkyl ether sulfate having the formula $$R_1-O-(CH_2CH_2O)_nSO_3M \quad (I)$$

and the balance is branched-alkyl ether sulfate having the formula $$R_2-\underset{\underset{R_3}{|}}{CH}-CH_2-O-(CH_2CH_2O)_nSO_3M \quad (II)$$

wherein $R_1$ is unbranched alkyl having a carbon atom number range of from 6 to 15 and wherein the average number of carbon atoms in $R_1$ of (I) is within the range of from 8 to 13, $R_2$ is unbranched alkyl having a carbon atom number range of from one to 12, $R_3$ is unbranched alkyl having a carbon atom number range of from one to 4, with the proviso that $$R_2-\underset{\underset{R_3}{|}}{CH}-CH_2-$$

has an average number of carbon atoms in the range of from 8 to 13, n is a number from 0.5 to 1.5 as an average for each of (I) and (II), and M is a water-solubilizing cation selected from the group consisting of alkali metals, alkaline earth metals, ammonium and alkanol amines;

and

B. an unbranched alkyl ether sulfate, or mixtures thereof, having the formula (III):

$$R_4-O-(CH_2CH_2O)_mSO_3M \quad (III)$$

wherein $R_4$ is unbranched alkyl having from 14 to 20 carbon atoms and $R_4$ has 18 carbon atoms for at least 80 percent by weight of the entirety of component (B), m is 1 to 50 on the average and M is as defined above for formulae (I) and (II), the ratio of (A) to (B) being in the range between 95:5 and 5:95 and the balance is water-soluble, anionic surfactant with the proviso that said anionic surfactant is not an ether sulfate, or water-soluble, synthetic, nonionic surfactant, or water-soluble, synthetic, amphoteric surfactant, or water-soluble alkaline or neutral inorganic builder salt, or water-soluble heavy metal-sequestering agents, or solubilizing agents, or water, or mixtures thereof.

2. A composition as claimed in claim 1 in which said mixture of ether sulfate surfactants (A) is prepared by adding to a mixture of alkanols having from 6 to 15 carbon atoms in the alkyl group and having an average number of carbon atoms of from 8 to 13, wherein at least 30% of said alkanols have a branch chain of $R_3$ at the 2-position, from 0.5 to 1.5 moles of ethylene oxide per mole of said alkanols, then sulfating and then neutralizing that reaction product, and said ether sulfate (B) is prepared by adding to a mixture of alkanols in which the alkanol having 18 carbon atoms in the alkyl group is at least 80% by weight of the total alkanols, from 1 to 50 moles of ethylene oxide per mole of said alkanols, then sulfating and then neutralizing that reaction product.

3. A composition as claimed in claim 1, containing from 2.5 to 25 percent by weight of said ether sulfate surfactant, said composition being free of sodium tripolyphosphate.

4. A composition as claimed in claim 1, being a liquid heavy duty detergent composition containing from 2.5 to 60 percent by weight of said ether sulfate surfactant.

5. A composition as claimed in claim 1 containing from 2 to 20 percent by weight of said ether sulfate surfactant.

6. A composition as claimed in claim 1 containing from zero to 40 percent by weight of water-soluble phosphate builder salts, from zero to 20 percent by weight of water-soluble heavy metal-sequestering agents, and from 5 to 40 percent by weight of alkaline and neutral water-soluble builder salts selected from the group consisting of silicates, carbonates, sulfates and borates.

7. A composition as claimed in claim 4 containing from one to 20 percent by weight of a solubilizing agent.

* * * * *